US005714045A

United States Patent [19]

Lasa et al.

[11] Patent Number: 5,714,045

[45] Date of Patent: Feb. 3, 1998

[54] JACKETED SACRIFICIAL ANODE CATHODIC PROTECTION SYSTEM

[75] Inventors: Ivan R. Lasa; Rodney G. Powers, both of Gainsville, Fla.; Douglas L. Leng, Greenville, Tenn.

[73] Assignees: Alltrista Corporation, Muncie, Ind.; Florida Department of Transportation, Tallahasse, Fla.

[21] Appl. No.: 748,524

[22] Filed: Nov. 8, 1996

Related U.S. Application Data

[63] Continuation of Ser. No. 410,093, Mar. 24, 1995, abandoned.

[51] Int. Cl.[6] ..... C23F 13/00

[52] U.S. Cl. ..... 204/197; 205/731; 205/732; 205/733; 205/734

[58] Field of Search ..... 204/196, 197; 205/730–734

[56] References Cited

U.S. PATENT DOCUMENTS

| | | | |
|---|---|---|---|
| 485,618 | 11/1892 | Farrel . | |
| 651,849 | 6/1900 | Haas . | |
| 2,752,308 | 6/1956 | Andrus | 204/196 |
| 2,817,634 | 12/1957 | McCall | 204/197 |
| 3,012,958 | 12/1961 | Vixler | 204/197 |
| 3,152,059 | 10/1964 | Wellington | 204/197 |
| 3,260,661 | 7/1966 | Kemp et al. | 204/148 |
| 3,718,554 | 2/1973 | Jacobs et al. | 204/147 |
| 3,830,634 | 8/1974 | Zaremski | 204/197 |
| 3,994,794 | 11/1976 | Bohne | 204/197 |
| 4,401,530 | 8/1983 | Clere | 204/284 |
| 4,506,485 | 3/1985 | Apostolos | 52/515 |
| 4,519,886 | 5/1985 | de Nora et al. | 204/196 |
| 4,544,465 | 10/1985 | Marsh | 204/148 |
| 4,692,066 | 9/1987 | Clear | 204/197 |
| 4,699,703 | 10/1987 | Norman | 204/196 |
| 5,098,543 | 3/1992 | Bennett et al. | 204/196 |
| 5,292,411 | 3/1994 | Bartholomew | 204/196 |
| 5,531,873 | 7/1996 | Pulliainen et al. | 204/196 |

OTHER PUBLICATIONS

Richard J. Kessler, et al., "Cathodic Protection using Scrap and Recycled Materials", Materials Performance, vol. 30, No. 6, National Association of Corrosion Engineers, Jun. 1991, pp. 29–31.

Richard J. Kessler, et al., Corrosion/91, Paper No. 555, "Cathodic Protection Using Scrap and Recycled Materials", NACE Annual Conference and Corrosion Show, Mar. 11–15, 1991.

*Primary Examiner*—T. Tung
*Attorney, Agent, or Firm*—Baker & Daniels

[57] ABSTRACT

A jacketed anode assembly for use in a sacrificial anode cathodic protection system deployed to impede corrosion of steel or steel reinforcement in pilings or similar supporting columns. A non-conductive jacket formed of mating shell halves is lined along its interior surface with sheets of expanded metal such as expanded zinc. The metal sheets are of a composition higher on the galvanic series than the steel reinforcement such that the sheets serve as sacrificial anodes when coupled with the steel reinforcement. The jacket and zinc lining are installed as a unit on the piling with the jacket interior surface facing the periphery of the piling and in spaced apart relationship therewith. In this space, a filling material can be introduced to both secure the metal sheets in place between the jacket and piling as well as serve as an electrolyte between the steel reinforcement and the metal sheet. The present invention also provides a method for impeding corrosion of a piling by sacrificial anode cathodic protection.

16 Claims, 5 Drawing Sheets

JACKETED SACRIFICIAL ANODE CATHODIC PROTECTION SYSTEM

This is a continuation of application Ser. No. 08/410,093, filed Mar. 24, 1995 and now abandoned.

BACKGROUND OF THE INVENTION

The present invention pertains to cathodic protection systems, and, in particular, to a sacrificial anode cathodic protection system employed to impede corrosion within bridge pilings and similar structures.

Numerous bridges throughout the world have experienced deterioration resulting in structural problems necessitating expensive repair or replacement. In addition to structural problems effecting the bridge decks, deterioration of the substructure or pilings of bridges is of significant concern. A major source of this deterioration stems from the use of steel reinforcement within the concrete piling.

Concrete embedded steel reinforcement within pilings is initially protected from corrosion by the development of a stable oxide film on its surface. This film is formed by chemical reaction between the highly alkaline concrete porewater and the steel. Corrosion of the steel is negligible until such time as the protective layer becomes saturated with chloride ions or by carbonation.

Corrosion of the steel reinforcement frequently develops as a result of wet-dry tidal cycling of saline water on pilings which are constructed of low resistivity and/or high permeability concrete. As the solid corrosion products known as red rust occupy a volume larger than that of the parent metal or steel, internal stresses are thereby created within the concrete. These stresses cause cracking and delamination of the concrete along the plane of the reinforcement. These cracking problems result in potentially serious structural problems and may require expensive maintenance or replacement.

A variety of technologies have been developed in attempts to remedy the deterioration of bridge pilings. One known technique utilizes jackets which are wrapped around the piling and then filled with concrete. This technique is primarily cosmetic, however, as the corrosion of the steel is not halted. As a result, corrosion of the piling continues as additional rust can subsequently form and cause cracks through the introduced concrete wrap.

Other techniques for corrosion remediation in bridge pilings utilize a cathodic protection system. A first type of cathodic protection method is known as impressed current cathodic protection. A rectifier attached to an alternating current power source establishes a direct current flow from an externally placed anode to the corroding reinforcing steel. The current flow transforms the steel into a cathode relative to the external anode and further corrosion of the steel is avoided. One such system utilizes a titanium wire mesh which is captured within grout introduced between a jacket and the deteriorating piling, and an external power source is circuited to the wire mesh to create the electron flow to the steel reinforcement. Another system uses carbon impregnated EPDM rubber sheets, circuited with the power source, which are firmly held against the piling by fiberglass panels. One disadvantage of these technologies pertains to their cost. In particular, a power line typically running along a length of the bridge is required to provide current to the apparatus. In jobs where only some of the pilings require remediation and especially where these pilings are disposed at distant portions of the bridge, the cost of providing the power lines for powering the apparatus can be prohibitive.

Another disadvantage of this system is its potential unreliability, as the continuous source of power may be interrupted by external factors such as an electrical storm.

Another type of cathodic protection method is known as sacrificial anode cathodic protection that produces a current flow by utilizing a metal higher in the galvanic series to negatively polarize the reinforcing steel. When coupled together in a common electrolyte such as concrete, the sacrificial anode and the reinforcing steel become a circuit. No external power source is required, as the electron flow is a result of the higher electromotive potential of the sacrificial anode relative to the steel. The current leaves the anode and flows to and polarizes the rebar sufficiently to eliminate the anodic and relatively cathodic areas at the surface of the rebar. The electron transfer results in a deterioration of the anode over time whereby the anode is consumed or sacrificed.

One known sacrificial anode cathodic protection technique for piling repair utilizes arc-sprayed zinc metalizing. After a portion of the steel reinforcement is exposed, a molten zinc spray is applied on the steel and on the exterior surfaces of the piling to provide a film layer of zinc which serves as the sacrificial anode. One potential shortcoming of this technique is its cost. Due to concerns over environmental contamination by the overspray of zinc, a containment system for the overspray should be employed which complicates and adds cost to installation. Other shortcomings include the shorter operational life of the smallish mass of zinc which is typically applied, as well as that this technique has less application in the intertidal zone due to the necessity of applying zinc to dry piling.

Another known sacrificial anode cathodic protection technique involves sheets of perforated zinc, such as the penny web or scrap produced in the making of pennies. A general description and background of this technique are disclosed in "Cathodic Protection using Scrap and Recycled Materials", Materials Performance, Volume 30, Number 6, National Association of Corrosion Engineers, June 1991, which is incorporated herein by reference. The penny web was placed flush against the surface of an existing piling and pressed firmly thereagainst by non-conductive, composite compression panels. The surfaces of the panels which contacted the penny web were provided with vertical channels to achieve capillary action that irrigated the zinc to provide a suitable wetted interface between the zinc and concrete piling. The penny web was then electrically connected to the steel reinforcement of the piling. For example, a portion of the concrete piling was removed to access the steel reinforcement or rebar, the rebar was checked for electrical continuity, and then the rebar was connected to a conductor which received an end of a wire circuited to the penny web.

One shortcoming with this penny web sacrificial anode cathodic protection system was that the spanning webs of the zinc were subject to fracture as the anode was consumed, which compromised the integrity of the circuit formed by the zinc. A second and significant shortcoming of the system was its difficulty in installation. Because the compression panels were of significant weight and distinct from the penny web, and because each side of the piling required a separate compression panel to force the web against its respective piling surface, installation was highly labor intensive. The compression panels had to be properly orientated around the web and subsequently secured together with stainless steel bands which circumscribed the panels. In addition, the penny web had to be preattached to the surfaces of the piling before compression panel mounting to make installation practical. Moreover, the concrete piling typically needed to be restored to its original profile prior to the mounting of the system.

In more recent designs, sheets of roller-flattened, expanded zinc metal have been substituted for the penny web to provide a greater mass of zinc to lengthen the service life of the system. As these sheets are subject to breakage upon bending, separate sheets of zinc were provided for each of the piling surfaces, and the separate sheets were then interconnected by horizontally extending zinc bands bent around the piling corners and electrically connected between the edges of the adjacent sheets. This system also suffered from the shortcoming of being labor intensive, as concrete restoration and preattachment of the zinc to the pilings was still required, and as separate compression panels were still required for proper installation to ensure a flush relationship between the zinc and piling which if lacking would compromise the ionic current flow from the zinc, through the concrete into the rebar.

Still another sacrificial anode cathodic protection system used for bridge repair involved flattened expanded metal which was pressed into contact with a concrete crossbeam by fiberglass grates. This system is also labor intensive to install due to the number of bolts required to anchor the fiberglass.

Thus, it would be desirable to provide a sacrificial anode cathodic protection system which overcomes the shortcomings of these and other prior art systems.

SUMMARY OF THE INVENTION

The present invention provides a jacketed anode assembly for sacrificial anode cathodic protection system for treating corrosion of a bridge piling which is simpler and therefore less expensive to install than many previous systems. A jacket which can be mounted around a bridge piling is lined with expanded zinc sheets that serve as a sacrificial anode. Filling material introduced into the space between the jacket and the piling provides a proper, contacting interface between the zinc sheet and the filling material and piling, and the filling material draws up moisture to effect the wetting of the concrete and filling material required for ionic current flow. The inventive assembly and its method of installation eliminates the need for restoration of the concrete piling and preattachment of the zinc to the piling, as well as eliminates separate compression panels.

In one form thereof, the present invention provides a jacketed anode assembly for use in a sacrificial anode cathodic protection system deployed to impede corrosion of a structure made at least in part of steel and which is exposed to an aquatic environment. The assembly includes an outer jacket and a lining for the jacket. The lining is disposed along the interior surface of the jacket and includes at least one metal element. The metal element comprises a metal composition higher on the galvanic series than the steel such that the element serves as a sacrificial anode when coupled with the steel. The anode assembly is sized and configured to be installed on the structure with the jacket interior surface in spaced apart relationship with the structure exterior surface to define a space therebetween in which the metal element is disposed. This space is adapted for introduction of a filler material.

In another form thereof, the present invention provides a method for impeding corrosion of a piling which is partially immersed in water and which is made at least in part of steel. The method involves providing an installation jacket having an upper edge and a lower edge; prelining an interior surface of the jacket with at least one metal element, wherein the metal element comprises a metal composition higher on the galvanic series than the steel; wrapping the prelined jacket around at least a portion of the piling periphery such that the jacket interior surface faces and is spaced from the piling periphery; introducing filling material into the space between the jacket and the piling periphery such that the metal element is secured to the piling periphery by the solidified filling material after filling material curing; and electrically connecting the metal element to the steel such that the metal element may serve as a sacrificial anode to impede further corrosion of the steel.

One advantage of the present invention is that installation of the sacrificial anode cathodic protection system is simplified as fewer component parts need to be simultaneously handled on-site.

Another advantage of the present invention is that no external source of power is required to be run along the length of the bridge to achieve cathodic protection of bridge pilings.

Another advantage of the present invention is that the bulky and heavy compression panels of prior art systems which are labor intensive to mount are eliminated.

Another advantage of the present invention is that a contacting relationship between the sacrificial anode and the electrolyte allowing ionic current flow therebetween is provided by utilizing mortar or grout to fill the gap between a concrete structure and the sacrificial anode.

Still another advantage of the present invention is that by utilizing mortar or grout to fill the space between the concrete structure and the sacrificial anode, the anode need not have a planar surface, and thereby a thicker, expanded metal sheet can be utilized rather than a roller-flattened expanded metal sheet which is subject to breakage for larger thicknesses.

Still another advantage of the present invention is that restoration of the concrete of the piling is not required prior to the installation of the inventive assembly.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
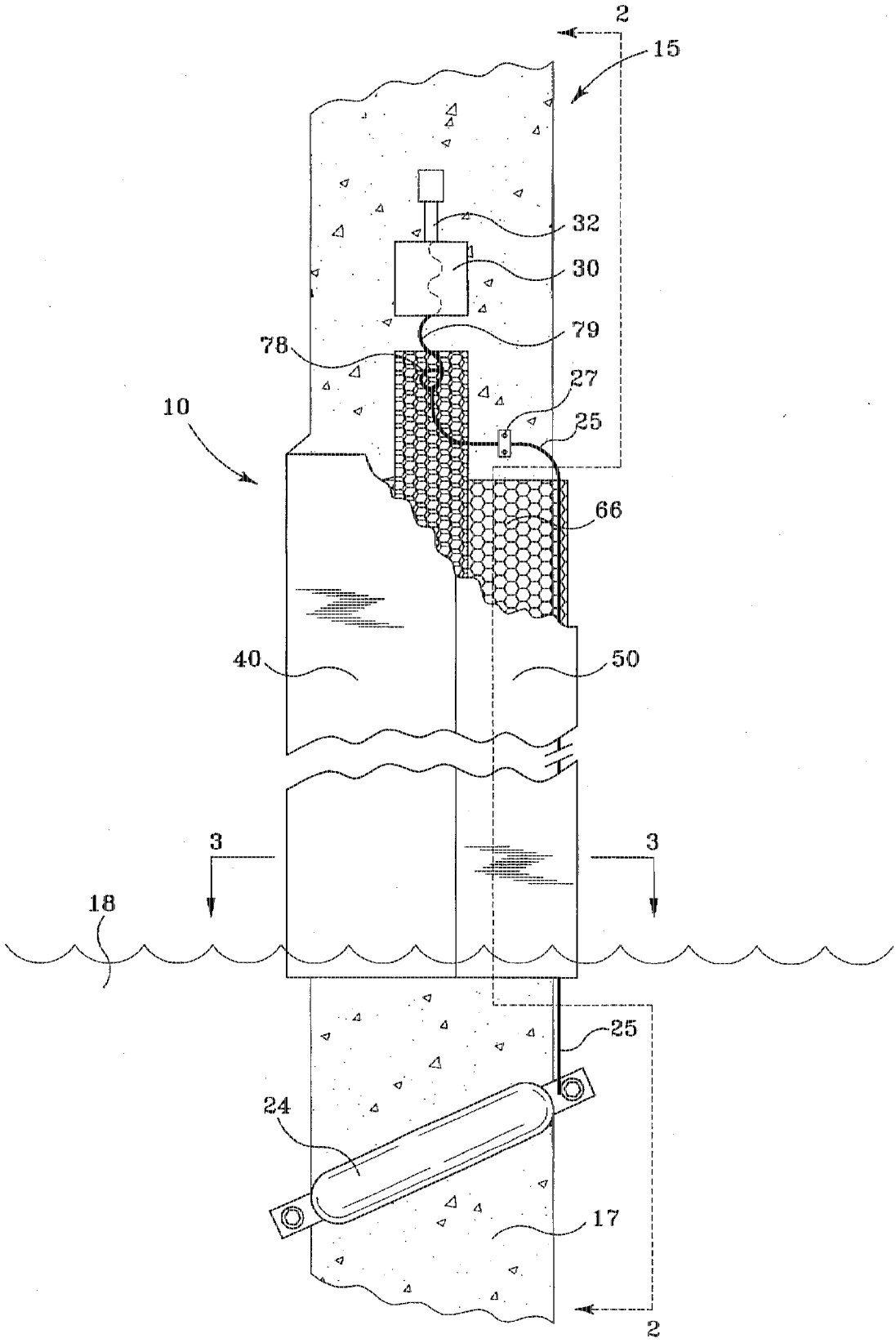
FIG. 1 is a diagrammatic front view of a jacketed anode assembly according to the principles of the present invention incorporated into a cathodic protection system mounted on a bridge piling or support structure.

Corresponding reference characters indicate corresponding parts throughout the several views. Although the drawings represent an embodiment of the invention, the drawings are not necessarily to scale and certain features may be exaggerated in order to better illustrate and explain the present invention.

DESCRIPTION OF THE PREFERRED EMBODIMENTS

Referring now to FIG. 1, there is diagrammatically shown a front view of a sacrificial anode cathodic protection system which utilizes a jacketed anode assembly 10 of the present invention. The sacrificial anode cathodic protection system is shown operationally installed on a partially shown column or piling 15, which may be supportive of any variety of structures such as a bridge deck, dock or a building. While the inventive system is envisioned finding most frequent application in remedying piling which have already experienced a degree of deterioration, the invention could be provided on newer pilings which have no visible signs of corrosion but for which corrosion prevention is desirable. In addition to bridges, the principles of the invention may also be applied with other structures wherein the corrosion impeding properties of the invention are beneficial.

Piling 15 is described herein as being stationed in a marine or seawater environment, which promotes piling corrosion due to both the salt in the water and the tidal changes which produce cyclical wetting and drying of a longitudinal segment of the height of piling 15. The invention may also be employed in other aquatic environments, such as with pilings stationed in freshwater, where corrosion may also occur though typically not to the same extent as the marine environment described. As shown in FIG. 1, the lower or base portion 17 of piling 15 is immersed in seawater 18, which is shown at a low tide level along the height of piling 15. The bottom of jacketed anode assembly 10 is situated approximately at the low tide level, and assembly 10 upwardly extends to cover at least the intertidal zone between low and high tides where the majority of piling corrosion due to rusting of the steel reinforcement typically occurs.

Figure 2:
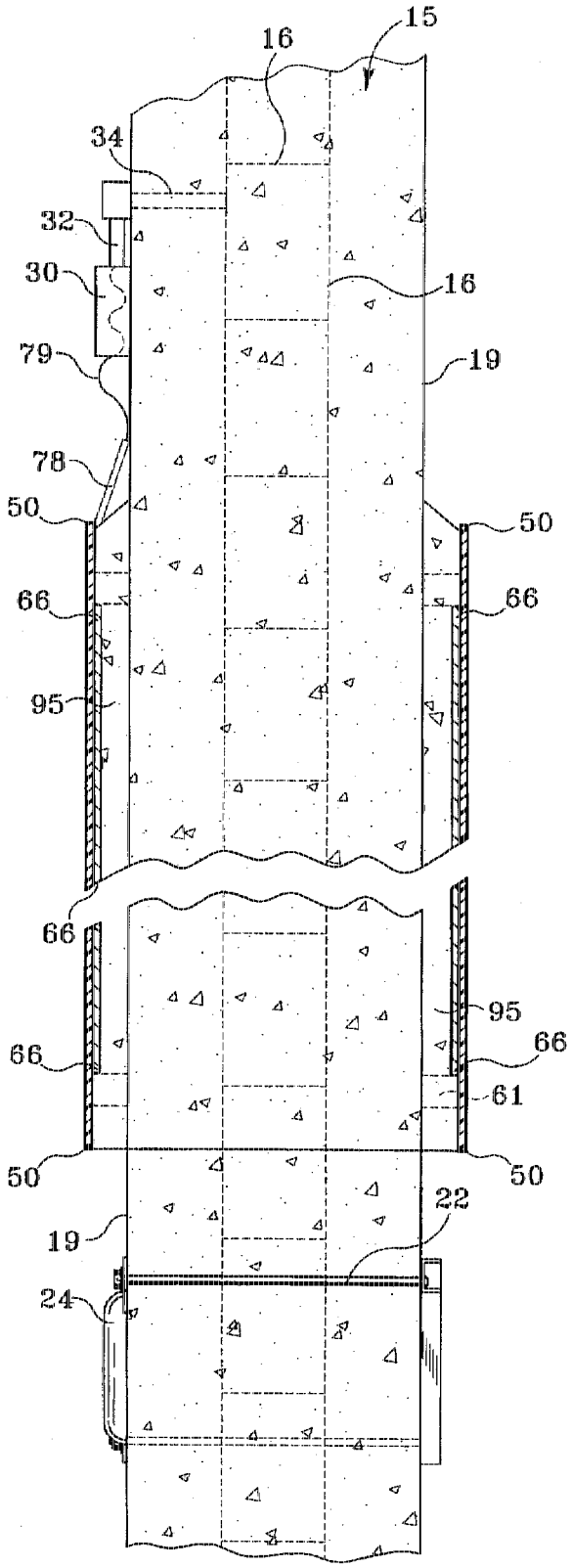
FIG. 2 is a side view in partial cross-section of the cathodic protection system and bridge piling of FIG. 1 taken along line 2—2.

As better shown in the partial cross-sectional view of FIG. 2, piling 15 is formed of concrete and as is conventional includes steel reinforcement, abstractly shown at 16. The present invention may be used when steel reinforcement 16 is formed of either rebar or prestressed strands in a manner well known in the art, as well as when alternatively configured reinforcement subject to rusting is present. In addition, the invention may also be used where the pilings are constructed of steel. Piling 15 is shown having an eighteen inch square cross-section with four orthogonally arranged faces or exterior surfaces 19 forming the piling periphery. Although the invention as shown and described is particularly suited to encircle this rectangular piling periphery, the inventive configuration can be adapted to readily accommodate differently shaped pilings. In addition, the rectangular jacket configuration could be used with other piling shapes, such as a cylindrical shape, provided care was taken during installation to keep the jacket spaced from the piling.

In conjunction with jacketed anode assembly 10, the sacrificial anode cathodic protection system is shown utilizing a variety of well known components already employed in the art and which are therefore explained but briefly for background purposes herein. With reference still to FIGS. 1 and 2, a ship hull type bulk anode 24 which is also consumed or sacrificed during the life of the system is mounted to piling 15 with abstractly shown galvanized clamp brackets 22. Bulk anode 24 is constructed from a highly active metal, such as zinc, and is submerged beneath the seawater low tide level a maximum distance of about two feet. Bulk anode 24 is connected via an electrical wire 25, which is routed within jacketed anode assembly 10, to a tab section 78 of the zinc lining of assembly 10 which is electrically connected by wire 79 with a junction or negative connection box 30 mounted to piling 15. Junction box 30 is exposed above jacketed anode assembly 10 and is utilized in conjunction with the upwardly projecting tab section 78 shown. In other embodiments, junction box 30 may be positioned within jacketed anode assembly 10, or box 30 as shown may alternatively be connected with a conductive band extending from a portion of the zinc lining covered by the assembly jacket. Wire 25 may be secured to piling 15 with stainless steel clamps 27 and hardware. A negative conduit 32 from box 30 leads to a suitable electrical conductor 34 that provides an electrical connection with the steel reinforcement 16. For the rebar configuration shown, an existing conductor 34 used is a stainless steel threaded rod tapped into a rebar 16 which is in electrical continuity with the balance of the steel reinforcement. Other methods such as welding and other mechanical attachments are known for electrical connection to the steel reinforcement, and the above explanation is not intended to limit the invention to such an electrical connection.

Bulk anode 24 provides a continuous delivery of current to the system, and better ensures sufficient current is generated during the initial operation of the system to achieve proper polarization of steel reinforcement 16. The size and composition of bulk anode 24 may be selected by one of skill in the art based on its expected consumption rate and the intended operational life of the system. A zinc bulk anode of approximately fifty pounds has previously been employed with prior sacrificial anode cathodic protection systems. Such a bulk anode is suitable for many applications, but in situations where additional current is required a larger mass anode or an additional bulk anode may be employed.

Figure 3:
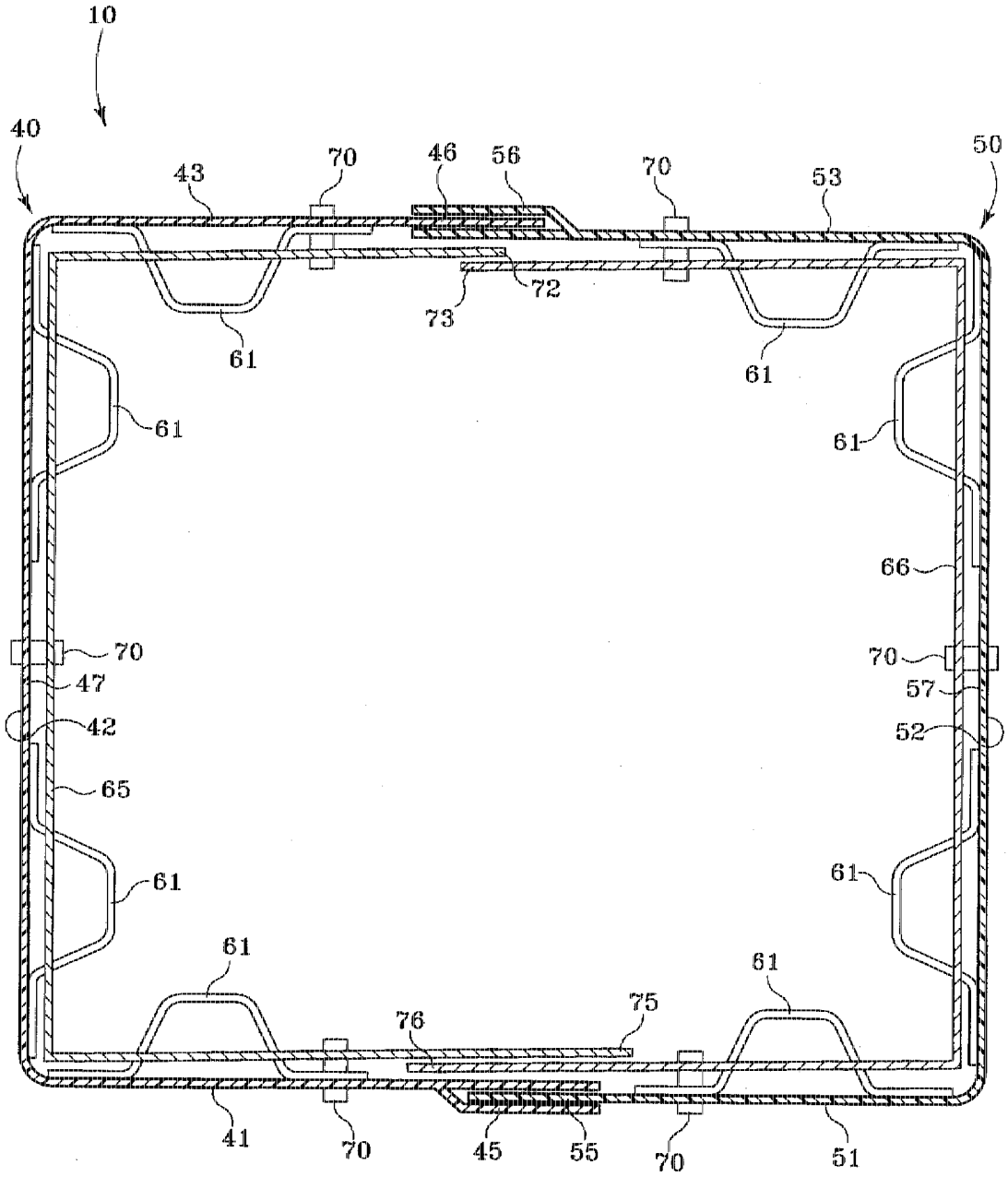
FIG. 3 is a cross-sectional top view, taken along line 3—3 of FIG. 1, of the jacketed anode assembly shown separate from the bridge piling and in an assembled configuration.
Figure 4:
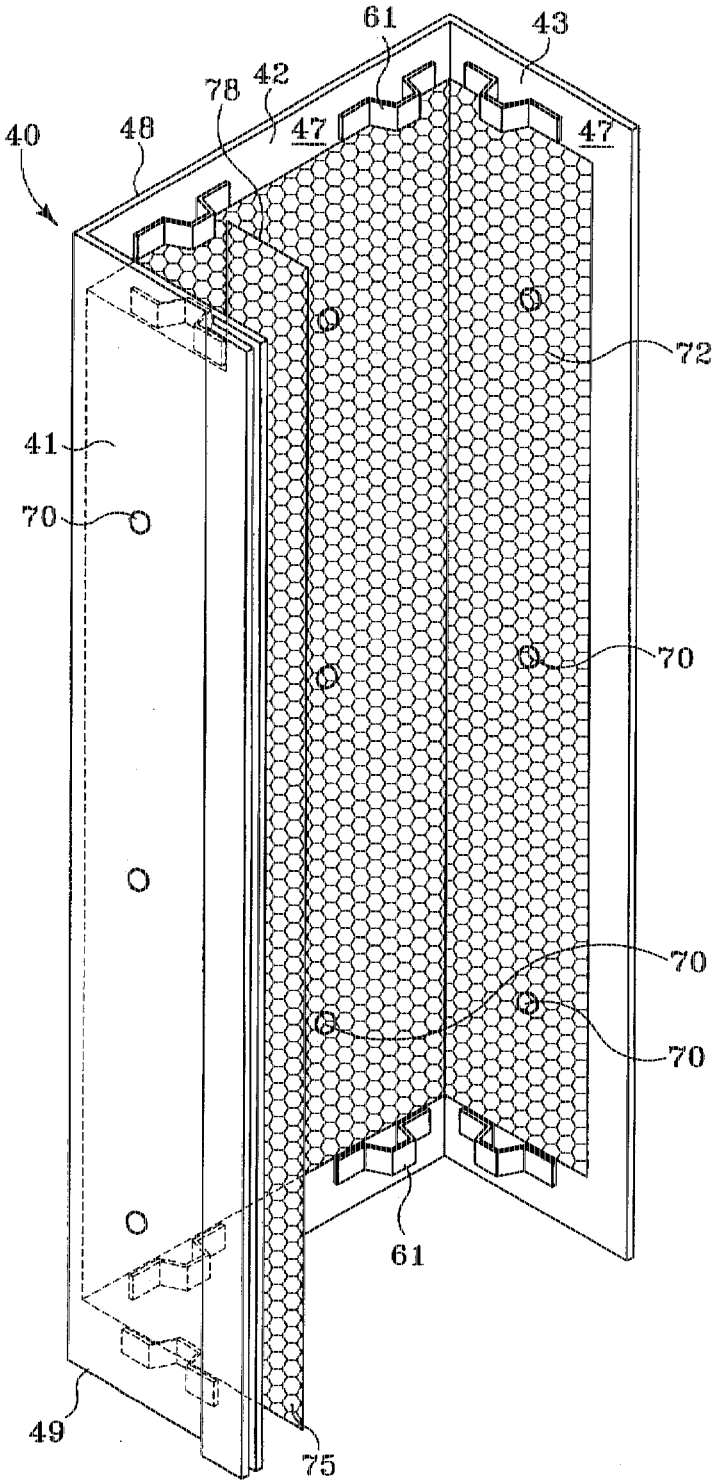
FIG. 4 is a perspective view of a jacket shell half prelined with a sacrificial anode of the jacketed anode assembly of FIG. 1.

The construction and mounting of the jacketed anode assembly will be further explained with additional reference to FIGS. 3 and 4. FIG. 3 is a horizontal cross-sectional view of a jacket anode assembly 10 separate from piling 15 and in an assembled condition. FIG. 4 is a perspective view of a prelined jacket shell half. Jacketed anode assembly 10 includes a mating pair of shell halves 40 and 50 formed of a lightweight, electrically non-conductive material such as fiberglass or plastic. Shell halves 40, 50 are complementarily shaped such that when connected they form a jacket or casing which completely circumscribes the periphery of piling 15. A primary function of shell halves 40, 50 is to facilitate the shipping and handling of the sacrificial anodes described below. Shell half 40 is substantially C-shaped in horizontal or transverse cross-section and includes orthogonally configured, solid wall segments 41, 42, 43. Shell half 50 is a substantial mirror image of shell half 40 and includes identically formed solid wall segments 51, 52, 53. An interlocking of shelf halves 40, 50 that maintains the jacket portions together during the initial aligning or positioning of the shell during mounting on piling 15 is achieved by suitable connectors such as a tongue and groove connection. As best shown in FIG. 3, groove section 45 and tongue section 46 integrally formed into the longitudinally oriented, distal edges of wall segments 41, 43 of shell half 40 are structured to frictionally engage tongue section 55 and groove section 56 of wall segments 51, 53 of shell half 50.

Attached to the interior surfaces 47, 57 of shell halves 40, 50 on each of their respective wall segments are standoffs 61 which inwardly project therefrom. Standoffs 61 provide a substantial centering of shell halves 40, 50 on piling 15 during mounting to obtain a spaced relationship between interior surfaces 47, 57 and the piling exterior surfaces 19. As better represented in FIG. 4, standoffs 61 are located proximate top edge 48 and bottom edge 49 of jacket shell half 40 and with the zinc lining disposed longitudinally therebetween. The standoffs 61 for shell half 50 are similarly arranged. The overall shape of standoffs 61 may be variously formed within the scope of the invention.

For the shown jacket configuration, the vertical height of shell portions 40, 50 from top edge 48 to bottom edge 49 is seventy-two inches, and the jacket extends along and above the intertidal zone wherein corrosion frequently would otherwise occur. For the eighteen inch square piling configuration described above, shell halves 40, 50 are formed with about three-sixteenth inch thick fiberglass walls and preferably enclose four sides of a parallelpiped volume which is twenty-two inches square in horizontal cross-section. For applications requiring the coverage of a larger splash zone, such as in tidal areas where a large body of water feeds a narrower stream and achieves a greater tidal change, a taller prelined jacket may be used. Because the jacketed anode assembly preferably covers the entire intertidal zone at least between high and low tides and typically slightly higher and lower thereof respectively, and because different parts of the world have different height tidal zones, the jacketed anode assembly can be particularly designed to suit a given tidal zone. Moreover, rather than the two-part jacket shown, other jacket configurations are within the scope of the invention. For example, a one-piece, articulated or clamshell jacket design may be provided rather than the separate jacket parts shown, and the jacket portions need not encircle approximately equal portions of the piling periphery. In addition, while wall segments 41–43 and 51–53 are preferably apertureless such that the shells prevent loss of filling material introduced between the jacket and piling during installation, if forms are utilized in conjunction with the jackets during installation then openings could be provided in the jackets.

As best shown in FIG. 3, sheets 65, 66 line interior surfaces 47, 57 of jacket shell halves 40, 50. Sheets 65, 66 are formed of an active metal ranked high on the galvanic series so as to serve as efficient sacrificial anodes when installed and effectively circuited with the more cathodic steel reinforcement 16. Active metals such as zinc, magnesium, aluminum and special metal alloys are suitable, but zinc is preferred due to its low cost and commercial availability and high performance in saltwater environments. Other materials could also be used which have a potential difference and are more active than the rusted steel. In the shown embodiment, zinc linings 65, 66 are each formed as a single, continuous sheet which is bent to conform to the configuration of the interior surfaces of its respective shell portion. Zinc sheet 65 is in abutting contact at its top and bottom ends with standoffs 61, and sheet 66 is similarly configured.

Elements other than sheets may alternatively be used to line the jacket interior surfaces. For example, a film layer of zinc provided by metalizing may be used, and structures such as strips or bars attached to the jacket may also be used.

To ensure they do not become separated or dislodged from their lined arrangement during the handling of assembly 10 associated with installation at the job site, zinc sheets 65, 66 are preferably secured to shell halves 40, 50. An appropriate securement is by diagrammatically shown, electrically nonconductive fasteners 70, such as neoprene or plastic fasteners of push rivets. Rivets 70, which are located at spaced intervals along each of the sheet sections of linings 65, 66, are inserted from inside the jacket through pre-drilled holes provided in shells 40, 50 to secure the zinc sheets to the jacket interior surfaces 47, 57. Although for purposes of illustration zinc sheets 65, 66 are shown spaced from interior surfaces 47, 57, zinc sheets 65, 66 are preferably secured flush with the interior surfaces by fasteners 70. This flush relationship better prevents sheets 65, 66 from being completely encapsulated within the introduced grout or mortar which would prevent the dispersion of zinc oxides formed during operation. It is recognized that the close conformity of linings 65, 66 to the shape of jacket shell halves 40, 50, coupled with the positioning of standoffs 61 to prevent longitudinal sliding of the linings within the jacket, already serves to maintain linings 65, 66 in their prelined arrangement such that additional mechanical fasteners may not be required in all applications.

At their respective edges 72 and 73, zinc sheets 65, 66 are structured to overlap, preferably along the entire longitudinal sheet height and for a overlap length of about two inches. At their opposite ends, sheet edges 75, 76 similarly overlap a length of between about four to six inches. These overlap portions are pressed into contact when filling material is introduced into the jacketed anode assembly 10 during installation described further below and ensure continuity of the electrical circuit within the zinc. At edge 75, zinc lining 65 is integrally provided with an upwardly extending tab 78, best shown in FIG. 4, that projects above jacket top edge 48. Tab 78 is arranged in overlapping fashion with a similar tab formed at edge 76 of zinc lining 66. The tabs provide for ready electrical connection with wire 79 circuited with junction box 30. In an alternate embodiment wherein the electrical connection to the steel reinforcement is disposed within the height of jacketed anode assembly 10, the tabs can be eliminated.

The structural configuration of zinc sheets 65, 66 may comprise any one or combination of a variety of forms within the scope of the invention. The actual selection of the zinc configuration by one of skill in the art is dependent on multiple competing criteria. For example, the zinc linings must furnish sufficient mass to account for the loss of zinc mass resulting from the zinc being consumed as a sacrificial anode, while at the same time the zinc linings should also provide sufficient exposed surface area to obtain appropriate electron transfer or ionic current flow directly between the zinc and introduced filling material described below. While solid sheets of zinc may be employed, apertured sheets are preferred as the apertures or openings therein are believed to provide a better surface to volume ratio for tidal wetting while providing an adequate mass to cathodically protect the corroded regions.

Figure 5:
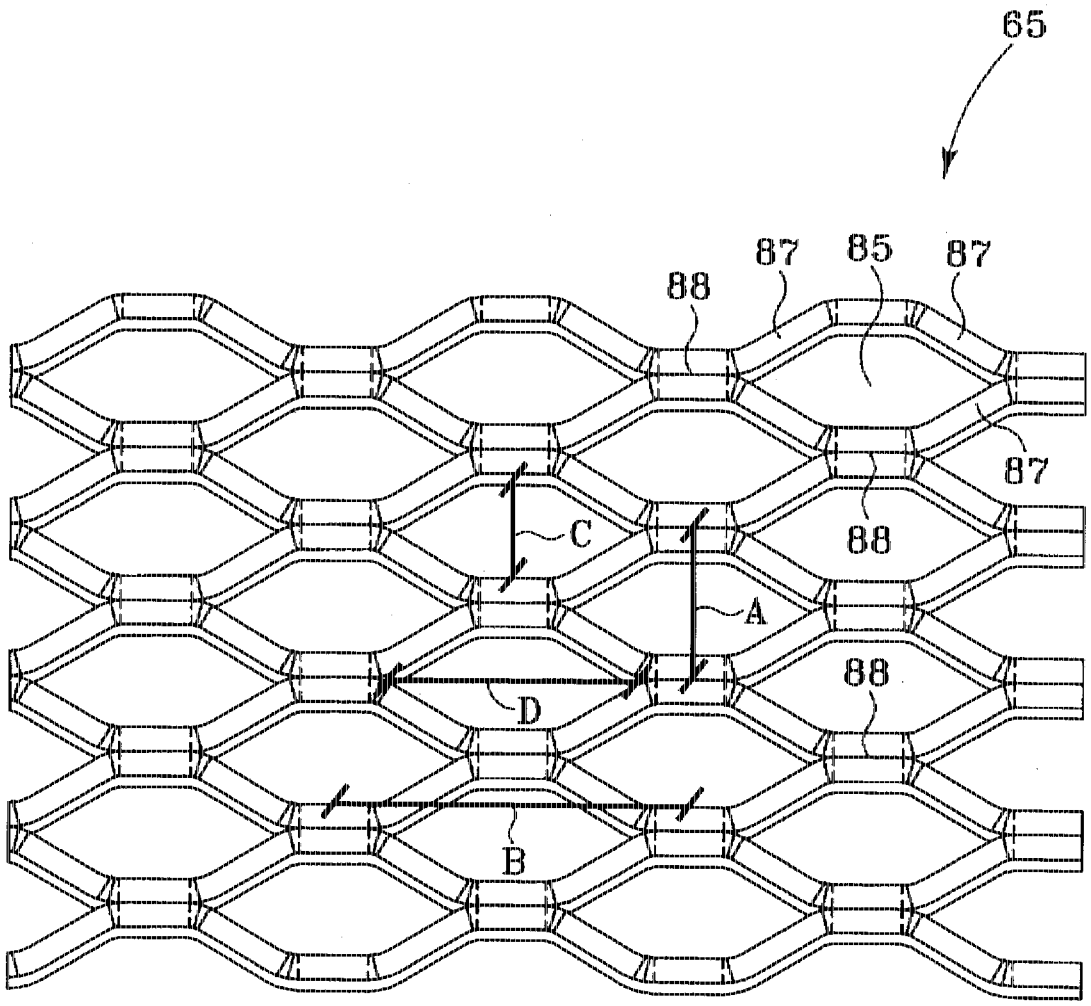
FIG. 5 is a an enlarged view of a portion of the sacrificial anode showing a non-flattened, expanded metal configuration.

A presently preferred apertured sheet configuration is shown in the partial, enlarged view of FIG. 5. The zinc sheet metal linings 65, 66 are separately formed by slitting and stretching a 0.090 inch thick segment of A-190 solid zinc strip, which is commercially available from Alltrista Zinc Products Company of Greeneville, Tenn., into a standard expanded metal pattern. Standard expanded metal is preferred over roller flattened expanded metal as the flattening tends to increase the likelihood of sheet fracture with larger sheet thicknesses, such as the preferred 0.090 inch thickness, which are used in situations where increased zinc mass per unit area covered by the lining is desired. Premature fracturing or failure may compromise the continuity of the electrical circuit in the lining and diminish the effectiveness of the lining as a sacrificial anode. The expanding process itself is known and can be performed by Niles Expanded Metal of Niles, Ohio. The preferred pattern, which creates generally hexagonal holes 85 defined by bowed or curved strands 87 that intersect at bond sections 88, is known as a one-half inch hex pattern expanded metal. Manufacturing specifications for a segment suitable for use in the invention are a strand width of about 0.125 inch, a Short Way of Design identified as dimension A of about 0.520 inch, a Long Way of Design identified as dimension B of about 1.4 inch, a Short Way of Opening identified as dimension C of about 0.320 inch, and a Long Way of Opening identified as dimension D of about 0.780 inch. The expanded metal sheet has a weight to covered area ratio of about 1.580 pounds per square foot, and the metal sheet has an open volume of 53% into which mortar or grout infiltrates. For the shown and described jacketed anode assembly 10, to provide a sacrificial anode lining of approximately 60 pounds, about 37.5 square feet of expanded zinc is utilized.

The curved or twisted strands 87 and bond sections 88 of the expanded metal permit the bending required to achieve the orthogonal sheet section orientations shown in FIG. 2. Bending is preferred to occur at the bond section areas to reduce the possibility of sheet fracture and provide a more precise bending line. For the shown lining C-shape configuration, it is preferred that the Long Way of Opening of the expanded zinc be oriented vertically in the lined jacket to facilitate bending. In some applications, it may be desirable to horizontally orient the Long Way of Opening as shown in FIG. 5 to provide better anchoring to the filling material. The expanded metal configuration advantageously allows separate, single sheets 65, 66 to be used to line each jacket shell portion 40, 50. In other embodiments, including those wherein other metal structural configurations are used such as a roller flattened expanded metal which is subject to breakage upon bending, separate planar sections of sheet metal may be secured to the wall segments 41–43 and 51–53 of the jacket shell portions. These sheet sections may then be interconnected by electrical connectors, such as bands of zinc soldered or crimped to the sections at their adjacent edges.

Prior to the mounting or installation of jacket anode assembly 10 on piling 15, piling 15 is cleaned of foreign materials which would prevent bonding between the concrete of the piling and the filling material to be introduced. Mounting begins by securing suitable base forms circumferentially around piling 15 at an elevation such that the top of the base forms is coextensive with the low tide level. Jacket mounting is typically performed after bulk anode 24 and its wire 25 are already connected to junction box 30 circuited with the steel reinforcement 16. Jacket shell portions 40, 50 are then set on the base forms on opposite sides of piling 15 and attached together via tongue and groove connection with piling 15 captured therein. Standoffs 61 center the connected jacket around piling 15 and achieve a space of about two inches between the jacket interior surfaces 47, 57 and piling exterior surfaces 19. Removable side, wood forms may be wrapped around the four exterior sides of connected jackets 40, 50 to prevent jacket bowing. A filling material is then poured into the space between jackets 40, 50 and piling 15. A suitable filling material is a commercially available Portland cement based grout or mortar of structural quality shown at 95 in FIG. 2. Filling material 95 fills the space between jackets 40, 50 and piling 15 to capture sheets 65, 66 and infiltrate sheet openings 85. Filling material 95 also fills in any cracks or crevices or section losses already existing in piling 15 due to concrete delamination. The infiltration of openings 85 serves to anchor the sheets 65, 66 within the hardened filling material as well as provides a filling material/metal contacting interface despite the non-planar surfaces of the zinc sheets that promotes ionic current flow. After filling material curing, the wood side forms and base forms may be removed. Wire 79 is connected between tabs 78 and junction box 30, and stainless steel self-tapping screws are inserted into the tongue and groove connectors to ensure the jacket remains secured together. Tidal erosion of the zinc is further minimized by the fiberglass jacket which prevents direct contact with seawater 18 as well as objects floating therein.

After installation of jacket anode assembly 10, the sacrificial anode cathodic protection system is operational. An electronic current is provided to the steel rebar 16 from submerged bulk anode 24 and the zinc linings through conductor 34. The electric circuit is initially completed by the portion of piling 15 near the bulk anode 24 whereat the concrete is saturated and functions as an electrolyte connecting the rebar and the anode. The porosity of filling material 95 and its inherent absorption or capillary properties draws seawater 18 upwardly above the instant seawater level by capillary action to moisten the filling material 95 as well as the adjacent portions of piling 15 and sacrificial anodes 65, 66. The zinc oxides which collect between the zinc sheets and the jacket interior surfaces are believed to provide a wicking action to aid in drawing moisture upwardly to wet the filing material and zinc lining interface. After the filling material and concrete is moistened through capillary action, the filling material and concrete serves as an electrolyte through which an ionic current flows such that electrons pass therethrough from the zinc sheet anodes to the steel cathode to supplement the electronic current delivered through conductor 34. A steady state ionic current flow, meaning a substantially uniform current deliverance and distribution, is typically reached after a period of about one year. The time period and the magnitude of the current is dependent upon filling material permeability and electrochemical properties and volume of the steel.

While this invention has been described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. In combination with a structural support including an exterior surface exposed to an aquatic environment, wherein the structural support comprises steel, a sacrificial anode cathodic protection system for impeding corrosion of the structural support comprising:

an outer jacket formed of a substantially rigid material and including a top edge, a bottom edge, and an interior surface;

a lining for said jacket, said lining disposed along said jacket interior surface and comprising at least one metal element, wherein said at least one metal element comprises a first surface portion facing said jacket interior surface;

said outer jacket and lining adapted to be installed on the structural support with said at least one metal element of said lining in spaced apart relationship with the structural support exterior surface to define a space therebetween;

a conductor electrically circuited between said at least one metal element of said lining and the structural support steel;

wherein said at least one metal element comprises a metal composition higher on the galvanic series than the structural support steel such that said element serves as a sacrificial anode and allows the collection of oxides at the surface portion facing said jacket interior surface upon consumption of said at least one metal element during service as said sacrificial anode; and a filler material cast within said space between said at least one metal element and said structural support exterior surface and subject to immersion in and thereby with water of the aquatic environment, wherein said at least one metal element of said lining is only partially encapsulated by said cast filler material such that at least a part of said first surface portion facing said jacket interior surface is uncovered by said cast filler material, said cast filler material adapted to provide a fill of crevices or section losses within the structural support exterior surface, and wherein ionic current flows from said at least one metal element to said structural support steel through said cast filler material.

2. The combination of claim 1 wherein the structural support comprises a piling extending in a longitudinal direction, and wherein said jacket is structured and arranged to circumscribe the piling periphery.

3. The combination of claim 2 wherein said at least one metal element comprises a tab section upwardly projecting above said jacket top edge, and wherein said tab section is electrically connectable to said conductor.

4. The combination of claim 2 wherein said jacket comprises a first shell part and a second shell part, wherein said at least one metal element comprises a first sheet lining the interior surface of said first shell part and a second sheet lining the interior surface of said second shell part.

5. The combination of claim 4 further comprising a plurality of mechanical fasteners securing said first sheet to said first shell part and said second sheet to said second shell part.

6. The combination of claim 4 wherein said first shell part and said second shell part each comprise standoff means for spacing said jacket interior surface from the piling during installation.

7. The combination of claim 4 wherein said first shell part is separate from said second shell part and cooperatively structured therewith to circumscribe the piling periphery when operatively connected together.

8. The combination of claim 7 wherein said first sheet and said second sheet overlap at opposite edges of each sheet when said first and second shell parts are connected.

9. The combination of claim 7 wherein said first shell part and said second shell part include cooperating tongue and groove connectors.

10. The combination of claim 7 wherein said first shell part and said second shell part when connected form a sleeve with four lateral facing exterior surfaces.

11. The combination of claim 4 wherein said first sheet and said second sheet each comprise apertures.

12. The combination of claim 11 wherein said first sheet and said second sheet each further comprises a non-flattened, expanded metal construction.

13. The combination of claim 12 wherein said first sheet and said second sheet comprise zinc.

14. In combination:

a piling partially immersed in water and comprising steel; and a sacrificial anode cathodic protection system comprising:

substantially rigid jacket means for surrounding a periphery of a longitudinal segment of said piling in substantially spaced apart relationship therewith, said jacket means comprising a bottom edge;

means for lining an interior surface of said jacket means with an active metal which serves as a sacrificial anode when circuited with said steel, said lining means comprising at least one metal sheet having a plurality of apertures and an outwardly facing surface portion facing and generally flush with said jacket means interior surface and allowing the collection of oxides at the outwardly facing surface portion upon consumption of said at least one metal sheet during service as said sacrificial anode;

means for securing said lining means to said jacket means to allow handling of said lining means and said jacket means as a unit during installation;

means for electrically connecting said lining means with said steel; and a structural quality concrete filling cast between said lining means and said piling, said cast concrete filling adapted to fill said sheet apertures and only partially encapsulate said at least one metal sheet such that at least a part of said outwardly facing surface portion is uncovered by said cast concrete filling, wherein said concrete filling comprises an exposed surface region uncovered by said jacket means for permitting sufficient water penetration to wet said concrete filling to facilitate current flow, wherein said concrete filling exposed surface region is disposed at a position along said piling so as to be immersed in and thereby in contact with water during at least some period of a day, said concrete filling having a porosity sufficient to draw moisture therein whereby said concrete filling serves as an electrolyte to facilitate ionic current flow from said lining means to said steel.

15. The combination of claim 14 wherein said jacket means bottom edge is spaced from said piling, and wherein said concrete filling exposed surface region is located between said jacket means bottom edge and said piling.

16. In combination:

a piling partially immersed in water and comprising steel reinforced concrete; and a sacrificial anode cathodic protection system comprising:

an outer jacket having a top edge, a bottom edge, and an interior surface;

a lining for said jacket, said lining secured to said jacket and generally flush with said jacket interior surface, said lining comprising at least one metal sheet having a plurality of apertures;

said outer jacket and lining adapted to be installed on the piling with said at least one metal sheet in spaced apart relationship with a periphery of the piling to define a space therebetween;

a conductor electrically circuited between said at least one metal sheet and the steel of said steel reinforced concrete;

wherein said at least one metal sheet comprises a metal composition higher on the galvanic series than the steel of said steel reinforced concrete such that said at least one metal sheet serves as a sacrificial anode and allows the collection of oxides at a surface flush with said jacket interior surface upon consumption of said at least one metal sheet during service as said sacrificial anode, said oxides providing a wicking action to draw the water upwardly to wet the at least one metal sheet; and a structural quality concrete filling cast within said space between said at least one metal sheet and said piling, said cast concrete filling adapted to provide a structural quality fill of crevices or section losses around the periphery of said piling, said cast concrete filling further adapted to fill said sheet apertures and only partially encapsulate said at least one metal sheet, said only partial encapsulation adapted to allow a dispersion of said oxides formed upon consumption of said at least one metal sheet during service as said sacrificial anode, wherein said east concrete filling comprises a surface region, uncovered by said outer jacket, disposed at a position along said piling so as to be immersed in and thereby in contact with water during at least some period of a day for inletting sufficient water to wet said cast concrete by capillary action, whereby said cast concrete filling serves as an electrolyte to facilitate ionic current flow from said at least one metal sheet to the steel of said steel reinforced concrete.

* * * * *

UNITED STATES PATENT AND TRADEMARK OFFICE

CERTIFICATE OF CORRECTION

PATENT NO. : 5,714,045

DATED : February 3, 1998

INVENTOR(S) : Ivan R. Lasa et al.

It is certified that error appears in the above-indentified patent and that said Letters Patent is hereby corrected as shown below:

Claim 1, column 11, line 11, after "thereby", and before "with", add -- contact --.

Claim 16, column 13, line 9, after "wherein said", replace "east" with -- cast --.

Signed and Sealed this

Twenty-first Day of April, 1998

Bruce Lehman

*Attest:*

BRUCE LEHMAN

*Attesting Officer*

*Commissioner of Patents and Trademarks*